US011257311B1

(12) United States Patent
Carpenter

(10) Patent No.: US 11,257,311 B1
(45) Date of Patent: Feb. 22, 2022

(54) LOCKING COOLER ASSEMBLY

(71) Applicant: Benjamin Carpenter, Centerville, MA (US)

(72) Inventor: Benjamin Carpenter, Centerville, MA (US)

( * ) Notice: Subject to any disclaimer, the term of this patent is extended or adjusted under 35 U.S.C. 154(b) by 0 days.

(21) Appl. No.: 17/082,131

(22) Filed: Oct. 28, 2020

(51) Int. Cl.

| | |
|---|---|
| ***G07C 9/00*** | (2020.01) |
| ***B65D 81/38*** | (2006.01) |
| ***B65D 25/04*** | (2006.01) |
| ***B65D 43/16*** | (2006.01) |
| ***G08B 3/10*** | (2006.01) |
| ***E05B 65/52*** | (2006.01) |
| ***G08C 17/02*** | (2006.01) |
| ***B65D 55/02*** | (2006.01) |

(52) U.S. Cl.
CPC ..... *G07C 9/00896* (2013.01); *B65D 25/04* (2013.01); *B65D 43/163* (2013.01); *B65D 55/02* (2013.01); *B65D 81/3813* (2013.01); *E05B 65/52* (2013.01); *G07C 9/00817* (2013.01); *G08B 3/10* (2013.01); *G08C 17/02* (2013.01)

(58) Field of Classification Search
CPC ..... G07C 9/00
See application file for complete search history.

(56) References Cited

U.S. PATENT DOCUMENTS

| | | | | |
|---|---|---|---|---|
| 4,326,383 | A * | 4/1982 | Reed | F25B 21/02 62/3.62 |
| 5,153,561 | A | 10/1992 | Johnson | |
| 5,301,508 | A * | 4/1994 | Kahl | F25B 21/02 62/3.62 |
| 6,658,857 | B1 * | 12/2003 | George | F25B 21/04 165/121 |
| 7,559,602 | B2 | 7/2009 | Ward | |
| D684,812 | S | 6/2013 | Johnson | |
| 8,740,010 | B1 | 6/2014 | Page | |
| 9,341,403 | B2 | 5/2016 | Conrad | |
| 9,928,387 | B2 | 3/2018 | Simpson | |
| 10,443,918 | B2 * | 10/2019 | Li | F25D 3/08 |
| 10,769,875 | B2 * | 9/2020 | Arellano | H04N 7/188 |
| 10,817,824 | B2 * | 10/2020 | Richardson | G06Q 10/0836 |
| 10,922,909 | B2 * | 2/2021 | Romero | G05B 9/02 |
| 2015/0369529 | A1 | 12/2015 | Monroe | |
| 2018/0354687 | A1 * | 12/2018 | Seiders | B65D 43/165 |
| 2019/0241349 | A1 * | 8/2019 | Pearson | B65D 81/3813 |

FOREIGN PATENT DOCUMENTS

| | | |
|---|---|---|
| WO | WO2006058174 | 6/2006 |

* cited by examiner

*Primary Examiner* — K. Wong

(57) ABSTRACT

A locking cooler assembly includes a cooler that can store perishable items. The cooler is comprised of a thermally insulating material to retain the perishable items at a preferred temperature. A divider is hingedly coupled to the cooler and the divider opens and closes the cooler. A lid is hingedly coupled to the divider and the lid and the divider define a storage space when the lid is closed for storing non-perishable items. A locking unit is coupled to the divider and the locking unit engages the lid when the locking unit is engaged to secure the objects stored in the storage space defined by the divider and the lid. A remote control is in remote communication with the locking unit to facilitate the user to remotely disengage the locking unit.

12 Claims, 6 Drawing Sheets

LOCKING COOLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cooler devices and more particularly pertains to a new cooler device for storing perishable items and for securely storing non-perishable items.

(2) Description of Related Art Including Information Disclosed Under 37 CFR 1.97 and 1.98

The prior art relates to cooler devices including a variety of lock boxes that each includes a locking mechanism for securely storing objects. The prior art also discloses a variety of coolers that each has a locking mechanism for locking the cooler.

BRIEF SUMMARY OF THE INVENTION

An embodiment of the disclosure meets the needs presented above by generally comprising a cooler that can store perishable items. The cooler is comprised of a thermally insulating material to retain the perishable items at a preferred temperature. A divider is hingedly coupled to the cooler and the divider opens and closes the cooler. A lid is hingedly coupled to the divider and the lid and the divider define a storage space when the lid is closed for storing non-perishable items. A locking unit is coupled to the divider and the locking unit engages the lid when the locking unit is engaged to secure the objects stored in the storage space defined by the divider and the lid. A remote control is in remote communication with the locking unit to facilitate the user to remotely disengage the locking unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
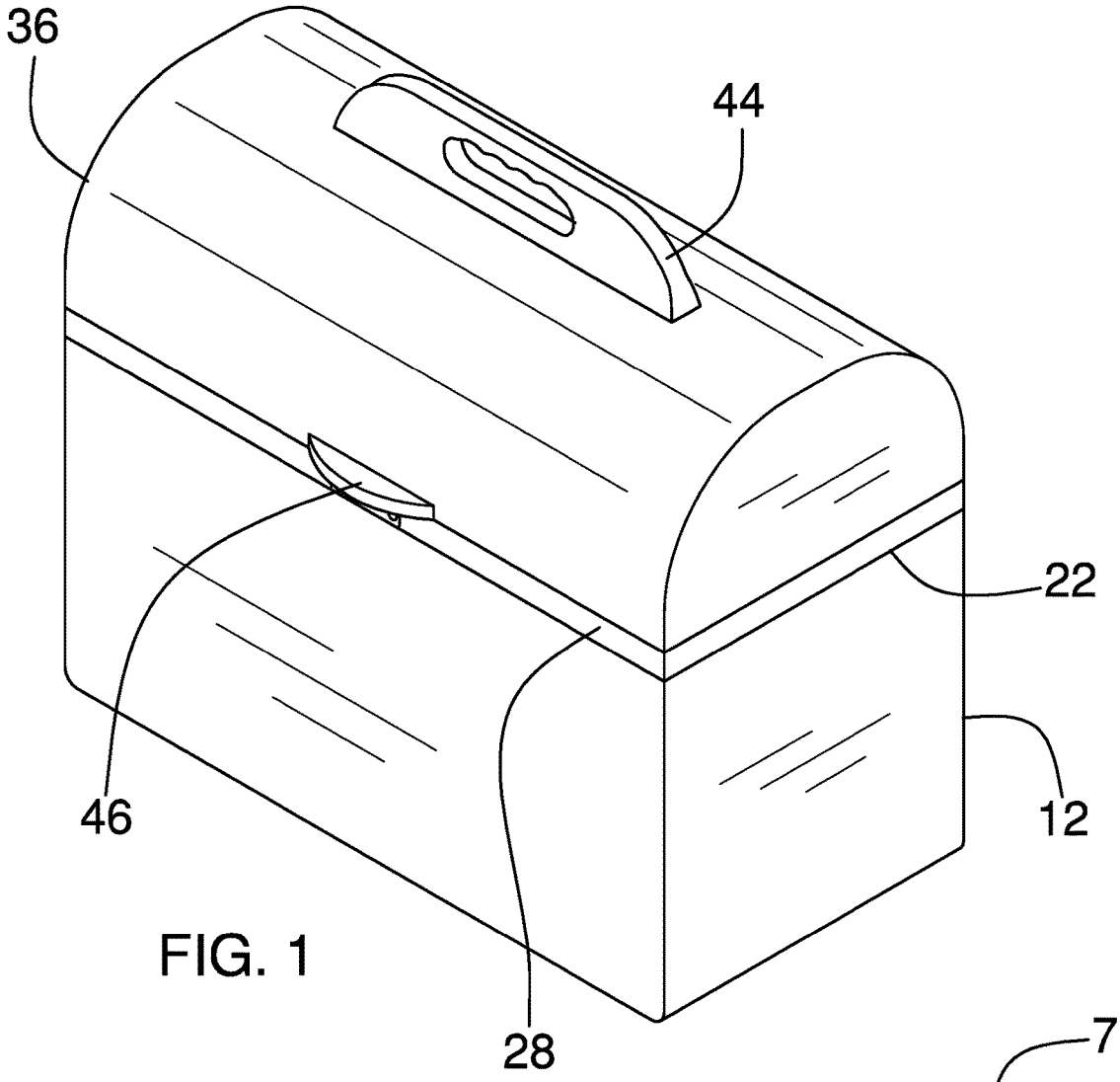
FIG. 1 is a perspective view of a locking cooler assembly according to an embodiment of the disclosure.
Figure 2:
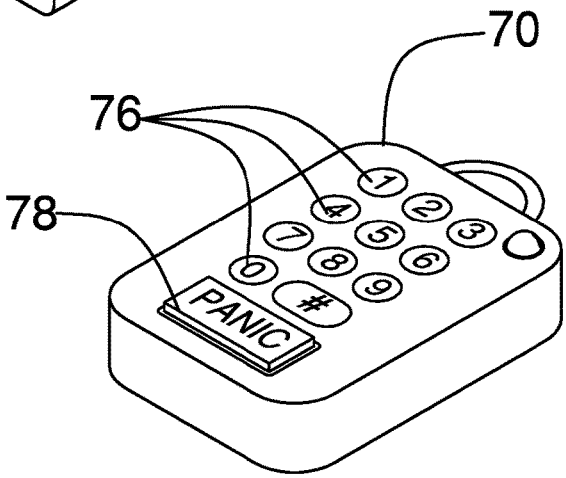
FIG. 2 is a perspective view of a remote control of an embodiment of the disclosure.
Figure 3:
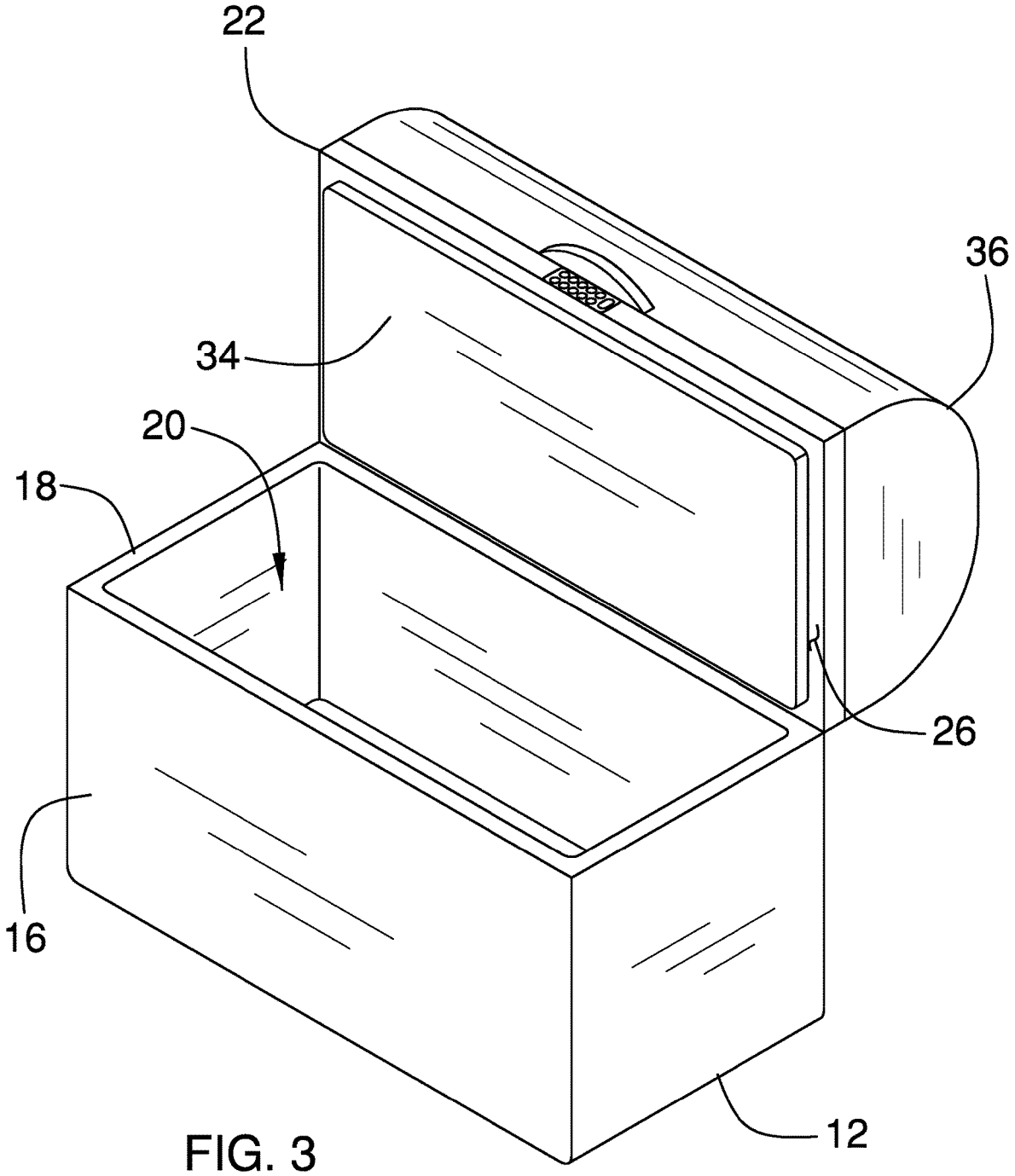
FIG. 3 is a perspective view of an embodiment of the disclosure showing a lid and a divider in an open position.
Figure 4:
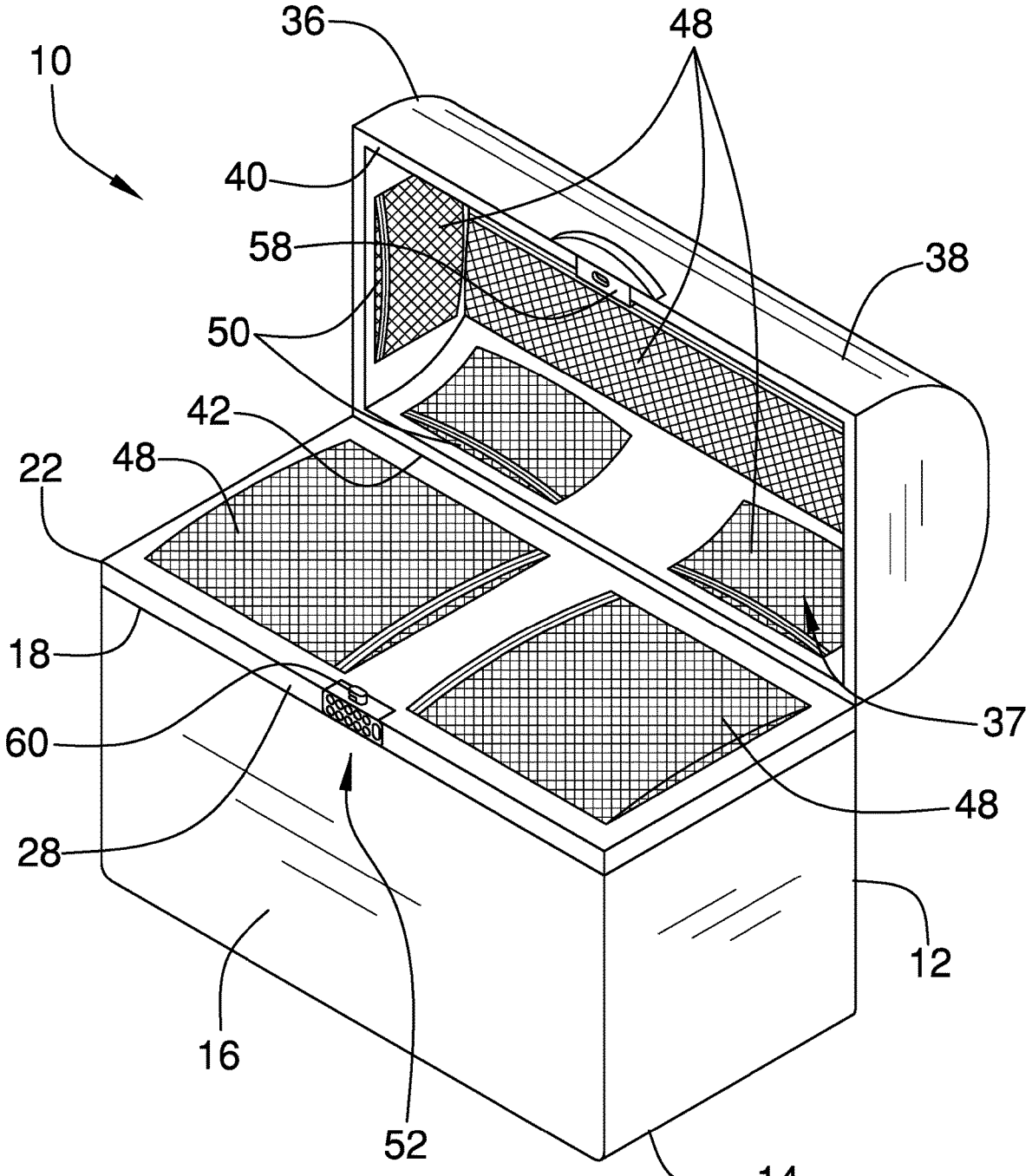
FIG. 4 is a perspective view of an embodiment of the disclosure showing a divider in a closed position and a lid in an open position.
Figure 5:
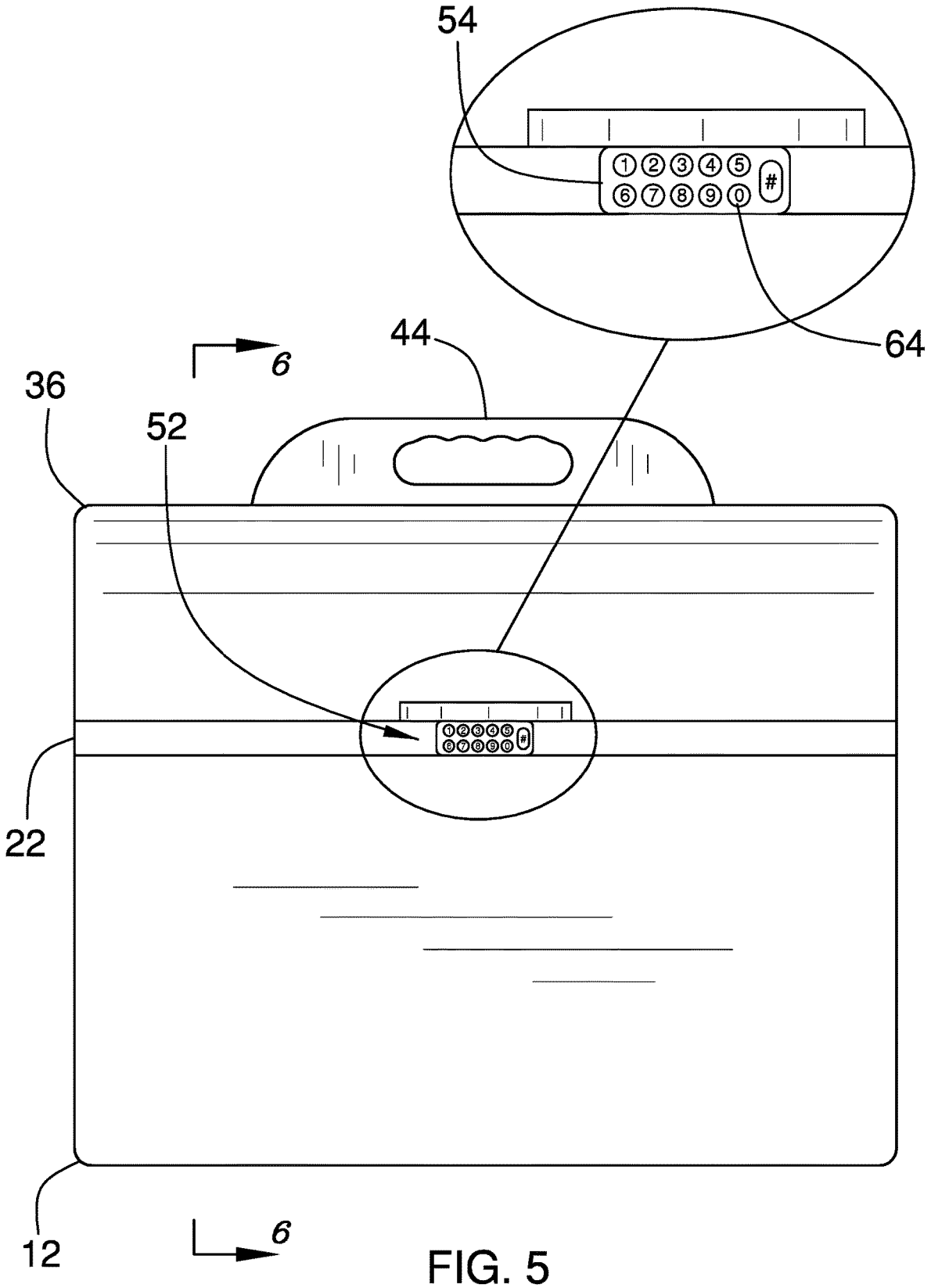
FIG. 5 is a front view of an embodiment of the disclosure.
Figure 6:
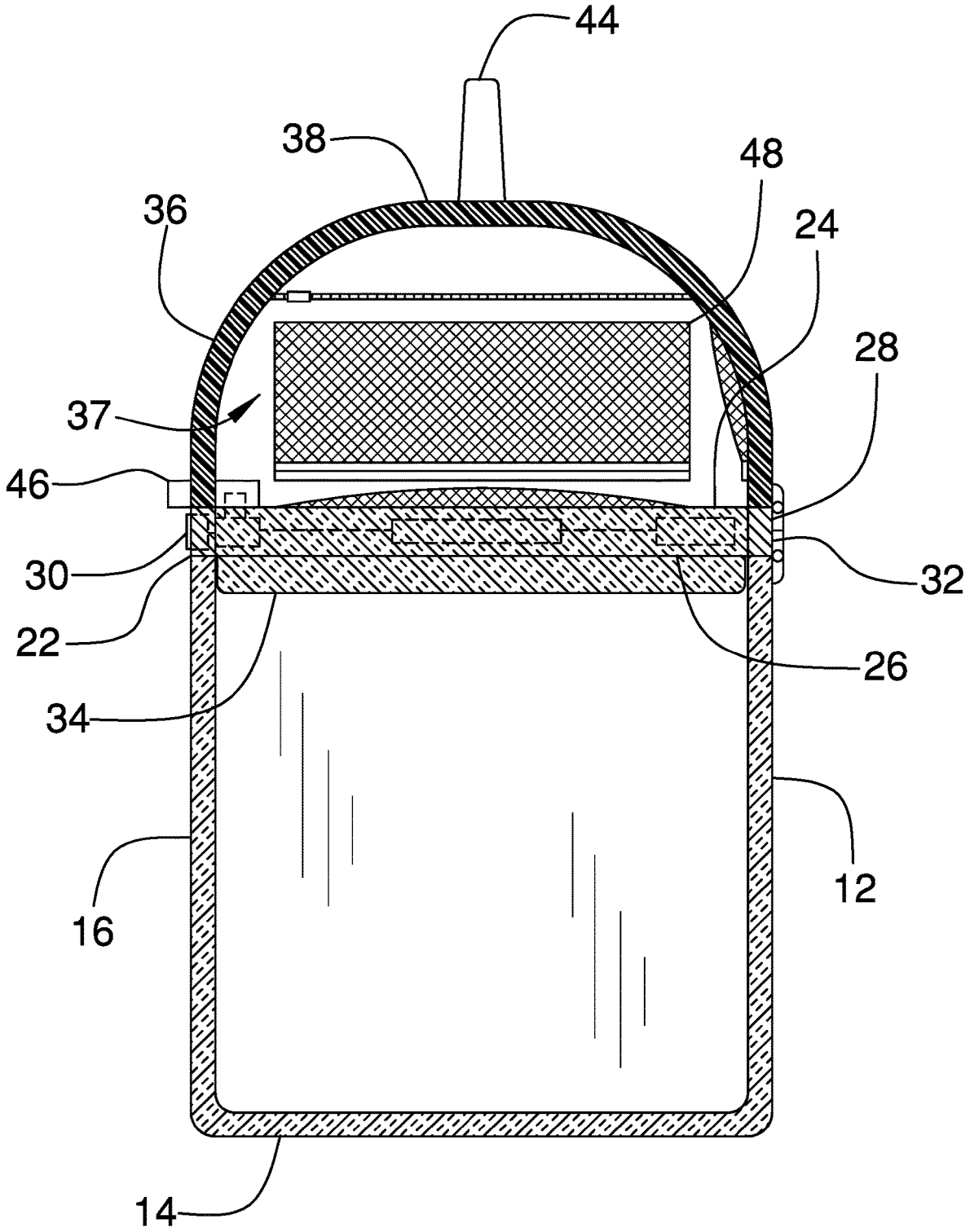
FIG. 6 is a cross sectional view taken along line 6-6 of FIG. 5 of an embodiment of the disclosure.
Figure 7:
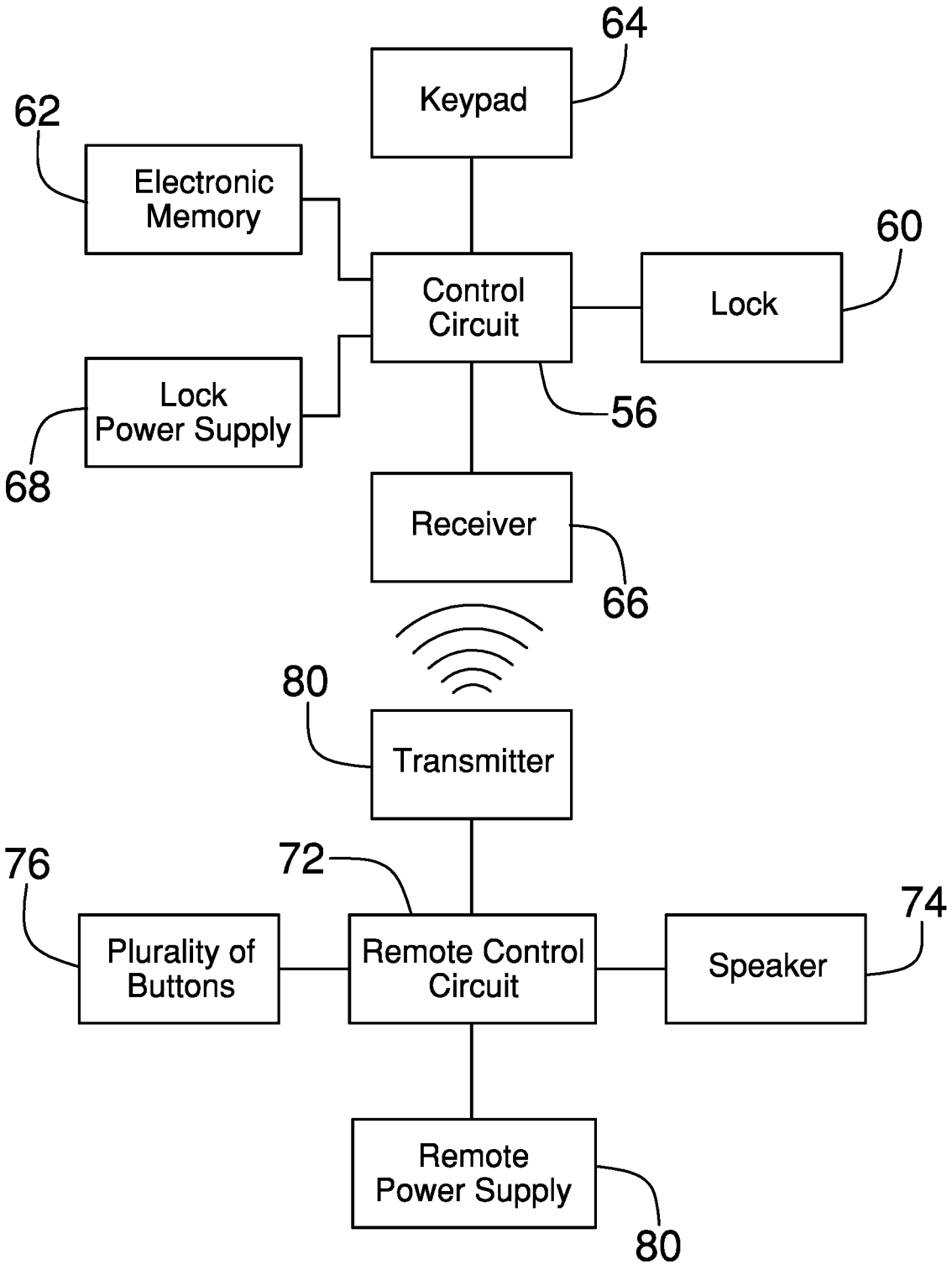
FIG. 7 is a schematic view of an embodiment of the disclosure.

With reference now to the drawings, and in particular to FIGS. 1 through 7 thereof, a new cooler device embodying the principles and concepts of an embodiment of the disclosure and generally designated by the reference numeral 10 will be described.

As best illustrated in FIGS. 1 through 7, the locking cooler assembly 10 generally comprises a cooler 12 for storing perishable items, such as food and beverages. The cooler 12 is comprised of a thermally insulating material to retain the perishable items at a preferred temperature. The cooler 12 has a bottom wall 14 and an outer wall 16 extending upwardly therefrom, and the outer wall 16 has a distal edge 18 with respect to the bottom wall 14 defining an opening 20 into the cooler 12. A divider 22 is hingedly coupled to the cooler 12 and the divider 22 opens and closes the cooler 12.

The divider 22 has a top surface 24, a bottom surface 26 and a perimeter edge 28 extending therebetween, and the perimeter edge 28 has a front side 30 and a back side 32. The back side 32 is hingedly coupled to the distal edge 18 of the outer wall 16 of the cooler 12. The bottom surface 26 rests on the distal edge 18 when the divider 22 is in a closed position and the divider 22 angles upwardly from the cooler 12 when the divider 22 is in an open position. The bottom surface 26 has a prominence 34 extending downwardly therefrom and the prominence 34 has a perimeter edge 28 that is spaced from and is coextensive with the perimeter edge 28 of the divider 22. Moreover, the prominence 34 extends downwardly into the cooler 12 when the divider 22 is in the closed position.

A lid 36 is included and the lid 36 is hingedly coupled to the divider 22. The lid 36 and the divider 22 define a storage space 37 when the lid 36 is closed for storing non-perishable items such as valuables, personal items or any other items that need to be protected from theft. The lid 36 has a top wall 38 that is concavely arcuate between a forward edge 40 and a rearward edge 42 of the lid 36. The rearward edge 42 is hingedly coupled to the back side 32 of the perimeter edge 28 of the divider 22. Additionally, each of the forward edge 40 and the rearward edge 42 rests on the top surface 24 of the divider 22 when the lid 36 is closed, and the lid 36 angles upwardly from the top surface 24 when the lid 36 is opened. A handle 44 may be attached to the top wall 38 of the lid 36 for carrying the lid 36 and the cooler 12. Additionally, a grip 46 may be attached to the top wall 38 of the lid 36 and the grip 46 may be aligned with the forward edge 40 for opening and closing the lid 36.

A plurality of pockets 48 is provided and each of the pockets 48 is coupled to a respective one of the divider 22 and the lid 36 such that each of the pockets 48 is positioned in the storage space 37. Each of the pockets 48 can receive the non-perishable items to secure the non-perishable items. Respective ones of the pockets 48 are positioned on the top surface 24 of the divider 22 and respective ones of the pockets 48 are positioned on an inside surface of the lid 36. Each of the pockets 48 may be comprised of a mesh material and each of the pockets 48 has a first end 50 that is open for insertably receiving the non-perishable items for storage.

A locking unit 52 is provided and the locking unit 52 is coupled to the divider 22. The locking unit 52 engages the lid 36 when the locking unit 52 is engaged to secure the objects stored in the storage space 37 defined by the divider 22 and the lid 36. The locking unit 52 disengages the lid 36 when the locking unit 52 is disengaged to facilitate the objects to be retrieved from the storage space 37. The locking unit 52 comprises a control panel 54 that is coupled to the perimeter edge 28 of the divider 22 such that the control panel 54 is accessible to a user.

The locking unit 52 includes a control circuit 56 is positioned in the control panel 54, and the control circuit 56 receives a lock input and an unlock input. The locking unit 52 also includes an engagement 58 that is coupled to the forward edge 40 of the lid 36. The engagement 58 includes a lock 60 that is coupled to the top surface 24 of the divider 22 and the lock 60 is electrically coupled to the control circuit 56. The lock 60 engages the engagement 58 when the lock 60 is turned on for locking the lid 36 to the divider 22. Conversely, the lock 60 disengages the engagement 58 when the lock 60 is turned off for unlocking the lid 36. The lock 60 is turned on when the control circuit 56 receives the lock input and the lock 60 is turned off when the control circuit 56 receives the unlock input. Moreover, the lock 60 may comprise an electromechanical lock or the like.

The locking unit 52 includes an electronic memory 62 that is positioned in the control panel 54 and the electronic memory 62 stores data comprising a predetermined numeric code. The electronic memory 62 is electrically coupled to the control circuit 56. The locking unit 52 includes a keypad 64 that is integrated into the control panel 54 such that the keypad 64 can be manipulated by the user. The keypad 64 is electrically coupled to the control circuit 56 and the control circuit 56 receives the unlock input when the keypad 64 communicates a numeric code to the control circuit 56 that matches the predetermined code stored in the electronic memory 62. In this way the keypad 64 facilitates the user to access the objects in the storage space 37.

The locking unit 52 includes a receiver 66 that is integrated into the control panel 54 and the receiver 66 is electrically coupled to the control circuit 56. The receiver 66 may comprise a radio frequency receiver or the like. The locking unit 52 includes a lock power supply 68 that is integrated into the control panel 54. The lock power supply 68 is electrically coupled to the control circuit 56 and the lock power supply 68 comprises at least one battery.

A remote control 70 is provided and the remote control 70 is in remote communication with the locking unit 52 to facilitate the user to remotely disengage the locking unit 52. The remote control 70 comprises a remote control circuit 72 that is integrated into the remote control 70 and the remote control circuit 72 receives an alarm input. A speaker 74 is integrated into the remote control 70 to emit an audible alert, the speaker 74 is electrically coupled to the remote control circuit 72 and the speaker 74 is turned on when the remote control circuit 72 receives the alarm input. A plurality of buttons 76 is provided and each of the buttons 76 is movably integrated into the remote control 70 such that each of the buttons 76 can be manipulated by the user for entering a numeric code. Each of the buttons 76 is electrically coupled to the remote control circuit 72 and the plurality of buttons 76 includes a panic button 78. The remote control circuit 72 receives the alarm input when the panic button 78 is depressed.

A transmitter 80 is integrated into the remote control 70, the transmitter 80 is electrically coupled to the remote control circuit 72 and the transmitter 80 is in wireless communication with the receiver 66 in the locking unit 52. The transmitter 80 broadcasts the numeric code entered with the buttons 76 to the receiver 66. Moreover, the control circuit 56 in the locking unit 52 receives the unlock input when the numeric code broadcast by the transmitter 80 matches the numeric code stored in the electronic memory 62 in the locking unit 52. The transmitter 80 may comprise a radio frequency transmitter or the like. A remote power supply 82 is integrated into the remote control 70, the remote power supply 82 is electrically coupled to the remote control circuit 72 and the remote power supply 82 comprises at least one battery.

In use, the perishable items are stored in the cooler 12, along with ice if necessary, to keep the perishable items fresh and safe for consumption. The non-perishable items are stored in respective pockets 48 in the storage space 37 and the lid 36 is closed on the divider 22 such that the locking unit 52 locks the lid 36. In this way the non-perishable items are inhibited from being stolen when the cooler 12 is left unattended. The numeric code is entered either with the keypad 64 or the remote control 70 to unlock the lid 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A locking cooler assembly for storing food items and personal items at a public location, said assembly comprising:

a cooler being configured to store perishable items, said cooler being comprised of a thermally insulating material wherein said cooler is configured to retain the perishable items at a preferred temperature;

a divider being hingedly coupled to said cooler, said divider opening and closing said cooler;

a lid being hingedly coupled to said divider, said lid and said divider defining a storage space when said lid is closed wherein said storage space is configured to store non-perishable items;

a plurality of pockets, each of said pockets being coupled to a respective one of said divider and said lid such that each of said pockets is positioned in said storage space wherein each of said pockets is configured to secure the non-perishable items;

a locking unit being coupled to said divider, said locking unit engaging said lid when said locking unit is engaged wherein said locking unit is configured to secure the objects stored in said storage space defined by said divider and said lid, said locking unit disengaging said lid when said locking unit is disengaged wherein said locking unit is configured to facilitate the objects to be retrieved from said storage space;

a remote control being in remote communication with said locking unit wherein said remote control is configured to facilitate the user to remotely disengage said locking unit;

wherein said cooler has a bottom wall and an outer wall extending upwardly therefrom, said outer wall having a distal edge with respect to said bottom wall defining an opening into said cooler; and wherein said divider has a planar top surface, a planar bottom surface and a perimeter edge extending therebetween, said perimeter edge having a front side and a back side, said back side being hingedly coupled to said distal edge of said outer wall of said cooler, said bottom surface resting on said distal edge when said divider is in a closed position, said divider angling upwardly from said cooler when said divider is in an open position.

2. The assembly according to claim 1, wherein said bottom surface has a prominence extending downwardly therefrom, said prominence having a perimeter edge, said perimeter edge of said prominence being spaced from and being coextensive with said perimeter edge of said divider, said prominence extending downwardly into said cooler when said divider is in said closed position.

3. The assembly according to claim 1, wherein said lid has a top wall being concavely arcuate between a forward edge and a rearward edge of said lid, said rearward edge being hingedly coupled to said back side of said perimeter edge of said divider, each of said forward edge and said rearward edge resting on said top surface of said divider when said lid is closed, said lid angling upwardly from said top surface when said lid is opened.

4. The assembly according to claim 3, wherein said locking unit comprises:

a control panel being coupled to said perimeter edge of said divider wherein said control panel is configured to be accessible to a user;

a control circuit being positioned in said control panel, said control circuit receiving a lock input, said control circuit receiving an unlock input; and an engagement being coupled to said forward edge of said lid.

5. The assembly according to claim 4, wherein said locking unit includes a lock being coupled to said top surface of said divider, said lock being electrically coupled to said control circuit, said lock engaging said engagement when said lock is turned on for locking said lid to said divider, said lock disengaging said engagement when said lock is turned off for unlocking said lid, said lock being turned on when said control circuit receives said lock input, said lock being turned off when said control circuit receives said unlock input.

6. The assembly according to claim 4, wherein said locking unit includes an electronic memory being positioned in said control panel, said electronic memory storing data comprising a predetermined numeric code, said electronic memory being electrically coupled to said control circuit.

7. The assembly according to claim 6, wherein said locking unit includes a keypad being integrated into said control panel wherein said keypad is configured to be manipulated by the user, said keypad being electrically coupled to said control circuit, said control circuit receiving said unlock input when said keypad communicates a numeric code to said control circuit that matches said predetermined code stored in said electronic memory wherein said keypad is configured to facilitate the user to access the objects in said storage space.

8. The assembly according to claim 4, wherein said locking unit includes a receiver being integrated into said control panel, said receiver being electrically coupled to said control circuit.

9. The assembly according to claim 1, wherein said remote control comprising:

a remote control circuit being integrated into said remote control, said remote control circuit receiving an alarm input; and a speaker being integrated into said remote control wherein said speaker is configured to emit an audible alert, said speaker being electrically coupled to said remote control circuit, said speaker being turned on when said remote control circuit receives said alarm input.

10. The assembly according to claim 9, further comprising a plurality of buttons, each of said buttons being movably integrated into said remote control wherein each of said buttons is configured to be manipulated by the user for entering a numeric code, each of said buttons being electrically coupled to said remote control circuit, said plurality of buttons including a panic button, said remote control circuit receiving said alarm input when said panic button is depressed.

11. The assembly according to claim 10, further comprising:

a control circuit being integrated into said control panel, said control circuit receiving an unlock input;

a receiver being integrated into said control panel, said receiver being electrically coupled to said control circuit; and a transmitter being integrated into said remote control, said transmitter being electrically coupled to said remote control circuit, said transmitter being in wireless communication with said receiver in said locking unit, said transmitter broadcasting said numeric code entered with said buttons to said receiver, said control circuit in said locking unit receiving said unlock input when said numeric code broadcast by said transmitter matches said numeric code stored in said electronic memory in said locking unit.

12. A locking cooler assembly for storing food items and personal items at a public location, said assembly comprising:

a cooler being configured to store perishable items, said cooler being comprised of a thermally insulating material wherein said cooler is configured to retain the perishable items at a preferred temperature, said cooler having a bottom wall and an outer wall extending upwardly therefrom, said outer wall having a distal edge with respect to said bottom wall defining an opening into said cooler;

a divider being hingedly coupled to said cooler, said divider opening and closing said cooler, said divider having a planar top surface, a planar bottom surface and a perimeter edge extending therebetween, said perimeter edge having a front side and a back side, said back side being hingedly coupled to said distal edge of said outer wall of said cooler, said bottom surface resting on said distal edge when said divider is in a closed position, said divider angling upwardly from said cooler when said divider is in an open position, said bottom surface having a prominence extending downwardly therefrom, said prominence having a perimeter edge, said perimeter edge of said prominence being spaced from and being coextensive with said perimeter edge of said divider, said prominence extending downwardly into said cooler when said divider is in said closed position;

a lid being hingedly coupled to said divider, said lid and said divider defining a storage space when said lid is closed wherein said storage space is configured to store non-perishable items, said lid having a top wall being concavely arcuate between a forward edge and a rearward edge of said lid, said rearward edge being hingedly coupled to said back side of said perimeter edge of said divider, each of said forward edge and said rearward edge resting on said top surface of said divider when said lid is closed, said lid angling upwardly from said top surface when said lid is opened;

a plurality of pockets, each of said pockets being coupled to a respective one of said divider and said lid such that each of said pockets is positioned in said storage space wherein each of said pockets is configured to secure the non-perishable items, respective ones of said pockets is positioned on said top surface of said divider, respective ones of said pockets being positioned on an inside surface of said lid;

a locking unit being coupled to said divider, said locking unit engaging said lid when said locking unit is engaged wherein said locking unit is configured to secure the objects stored in said storage space defined by said divider and said lid, said locking unit disengaging said lid when said locking unit is disengaged wherein said locking unit is configured to facilitate the objects to be retrieved from said storage space, said locking unit comprising:

a control panel being coupled to said perimeter edge of said divider wherein said control panel is configured to be accessible to a user;

a control circuit being positioned in said control panel, said control circuit receiving a lock input, said control circuit receiving an unlock input;

an engagement being coupled to said forward edge of said lid;

a lock being coupled to said top surface of said divider, said lock being electrically coupled to said control circuit, said lock engaging said engagement when said lock is turned on for locking said lid to said divider, said lock disengaging said engagement when said lock is turned off for unlocking said lid, said lock being turned on when said control circuit receives said lock input, said lock being turned off when said control circuit receives said unlock input;

an electronic memory being positioned in said control panel, said electronic memory storing data comprising a predetermined numeric code, said electronic memory being electrically coupled to said control circuit;

a keypad being integrated into said control panel wherein said keypad is configured to be manipulated by the user, said keypad being electrically coupled to said control circuit, said control circuit receiving said unlock input when said keypad communicates a numeric code to said control circuit that matches said predetermined code stored in said electronic memory wherein said keypad is configured to facilitate the user to access the objects in said storage space;

a receiver being integrated into said control panel, said receiver being electrically coupled to said control circuit; and a lock power supply being integrated into said control panel, said lock power supply being electrically coupled to said control circuit, said lock power supply comprising at least one battery; and a remote control being in remote communication with said locking unit wherein said remote control is configured to facilitate the user to remotely disengage said locking unit, said remote control comprising:

a remote control circuit being integrated into said remote control, said remote control circuit receiving an alarm input;

a speaker being integrated into said remote control wherein said speaker is configured to emit an audible alert, said speaker being electrically coupled to said remote control circuit, said speaker being turned on when said remote control circuit receives said alarm input;

a plurality of buttons, each of said buttons being movably integrated into said remote control wherein each of said buttons is configured to be manipulated by the user for entering a numeric code, each of said buttons being electrically coupled to said remote control circuit, said plurality of buttons including a panic button, said remote control circuit receiving said alarm input when said panic button is depressed;

a transmitter being integrated into said remote control, said transmitter being electrically coupled to said remote control circuit, said transmitter being in wireless communication with said receiver in said locking unit, said transmitter broadcasting said numeric code entered with said buttons to said receiver, said control circuit in said locking unit receiving said unlock input when said numeric code broadcast by said transmitter matches said numeric code stored in said electronic memory in said locking unit; and a remote power supply being integrated into said remote control, said remote power supply being electrically coupled to said remote control circuit, said remote power supply comprising at least one battery.

* * * * *